US005584074A

United States Patent [19]

Battle-Smith

[11] Patent Number: 5,584,074

[45] Date of Patent: Dec. 17, 1996

[54] ARTICLE HOLDING LOOP ON SHIRT

[76] Inventor: Michael Battle-Smith, 130 26th St., NW., Unit 104, Atlanta, Ga. 30309

[21] Appl. No.: 427,245

[22] Filed: Apr. 24, 1995

Related U.S. Application Data

[63] Continuation of Ser. No. 310,924, Sep. 22, 1994, abandoned, which is a continuation of Ser. No. 121,193, Sep. 15, 1993, abandoned, which is a continuation-in-part of Ser. No. 801,173, Jan. 29, 1992, abandoned.

[51] Int. Cl.[6] ..... A41B 1/00

[52] U.S. Cl. ..... 2/115; 2/113; 2/108

[58] Field of Search ..... 2/108, 77, 102, 2/106, 113, 115, 116, 271, 244, 94, 239

[56] References Cited

U.S. PATENT DOCUMENTS

| | | | |
|---|---|---|---|
| 428,099 | 5/1890 | Hutchinson | 2/115 |
| 2,609,541 | 9/1952 | Kaplan | 2/115 |
| 2,634,422 | 4/1953 | Cantrell | 2/271 |
| 2,750,595 | 6/1956 | Hollinger | 2/113 |
| 3,997,921 | 12/1976 | Knight | 2/271 |
| 4,637,075 | 1/1987 | Ingrisano et al. | 2/94 |
| 4,825,471 | 5/1989 | Jennings | 2/115 |
| 4,876,724 | 10/1989 | Suzuki | 2/94 |
| 4,885,805 | 12/1989 | Mason | 2/115 |
| 4,896,377 | 1/1990 | Ferdi | 2/271 |
| 4,917,651 | 4/1990 | Rainville | 2/271 |

FOREIGN PATENT DOCUMENTS

| | | | |
|---|---|---|---|
| WO9104684 | 4/1991 | European Pat. Off. | 2/239 |

*Primary Examiner*—C. D. Crowder
*Assistant Examiner*—Gloria Hale
*Attorney, Agent, or Firm*—Thomas A. Turner, Jr.

[57] ABSTRACT

An elongated element has two ends, each of which is attached to a garment a spaced distance apart from each other to form a loop with the garment, the spaced distance being determined by the structure of an object which the loop is designed to hold in close proximity to the wearer of the garment. The loop can be formed with the collar, a pocket, seam or on a surface of the garment.

5 Claims, 3 Drawing Sheets

78
88
90
82
92
84
102
106
104
98
106
100
96
118
114
116
120
112
110
80
92
82
84
86

ARTICLE HOLDING LOOP ON SHIRT

CONTINUATION-IN-PART APPLICATION

This is a continuation application of application Ser. No. 08/310,924 filed on Sep. 22, 1994; now abandoned which in turn was a continuation application of Ser. No. 08/121,193 filed on Sep. 15, 1993, now abandoned; which in turn was a continuation-in-part application of then Ser. No. 801,173 filed on Jan. 29, 1992, now abandoned. Priority of all subject matter common to said parent application Ser. No. 801,173 and this application is hereby claimed.

BACKGROUND OF THE INVENTION

1. Field of the Invention

The present invention relates to the art of garment construction and more particularly to attachments for garments for holding objects.

2. Description of the Prior Art

Many garments, such as shirts are designed for wear by active persons where the garments frequently do not have pockets for holding objects. Nevertheless, it is frequently desired by wearers of such garments that the garments have the capability of holding certain objects near to the wearer for ready access. In this specification, the term "shirt" will be used to mean garments for covering the upper torso of the wearer generally, and is meant to include such garments as sweatshirts, sweaters, pull-overs, T-shirts, jackets, rain gear and like garments. Many such shirts have pockets, but it is desired not to use such pockets for some items, such as glasses such as, for example, where the pocket is opened at the top and the object, such as a pair of glasses will fall out of the pocket when the wearer leans over to effectively turn the pocket upside down.

In the past, there have been provided garments with design features for holding objects onto the garment. One such garment may be seen, for example, in U.S. Pat. No. 2,750,595 issued to Hollinger, in which a conventional T-shirt type of undergarment has a collar, called a neck band for wearing around the neck, which neck band has buttonholes through which buttons of a more formal collar, such as a Roman collar may be inserted for holding the Roman collar to the T-shirt. Such holes generally are small, designed to hold the button tightly so that during normal pull and tensions of the button against the hole, the button will not be released from the hole. The difficulty of removing the button or like object from the hole is indicative of the difficulty with which the button or object is inserted into the hole in such designs. Indeed, most require two hands to insert the object, such as a button into the hole.

It has also been known to provide loops depending from such a neck band or collar of T-shirts. Typically, a length of material is joined to a neck band or collar at the joining seam, both ends being joined at the same or very close point with each other, so that the loop formed is substantially defined by the length of the material itself. The loop itself thus forms what may be described as a "hole" depending from the seam wherein the loop material is joined to the garment. Such loops have usefulness in that objects having a elongated part may have the elongated part inserted through the closed loop formed by the encircling material depending from the joinder point with the garment. However, such loops that are closed by having their two opposing ends attached to a garment at the same point frequently require the simultaneous use of the fingers of both hands both hands to open the loop before an object, such as an arm of a glasses' frame can be inserted.

It has been sought to provide a straightforward but effective loop depending from a garment designed to be worn by a person, in or through which an elongated part of an object can be inserted, where the loop is so designed that it is generally open and through which loop the elongated part of an object may be inserted by a wearer using only one hand or the fingers of one hand.

SUMMARY

In brief, in accordance with one aspect of the present invention, a shirt has parts where a seam runs along part of the garment. The seam can hold a neck band or collar to the main part of the garment, or may hold a sleeve or a pocket or be along an opening in the garment to define a sleeve or a pocket. A length of material has two ends joined to the shirt at points in the seam spaced a predetermined distance apart from each other, to form a closed loop in which the seam of the collar or other part of the garment is part of the periphery of the loop. The orientation of the joinder of the two ends of the elongated material is made so that the material stands slightly outwardly to be open and receptive to the insertion of an elongated feature of an object, such as the arm of a pair of glasses.

Other novel features which are believed to be characteristic of the invention, both as to organization and methods of operation, together with further objects and advantages thereof, will be better understood from the following description in which preferred embodiments of the invention are described by way of example.

DESCRIPTION OF THE PREFERRED EMBODIMENTS

Figure 1:
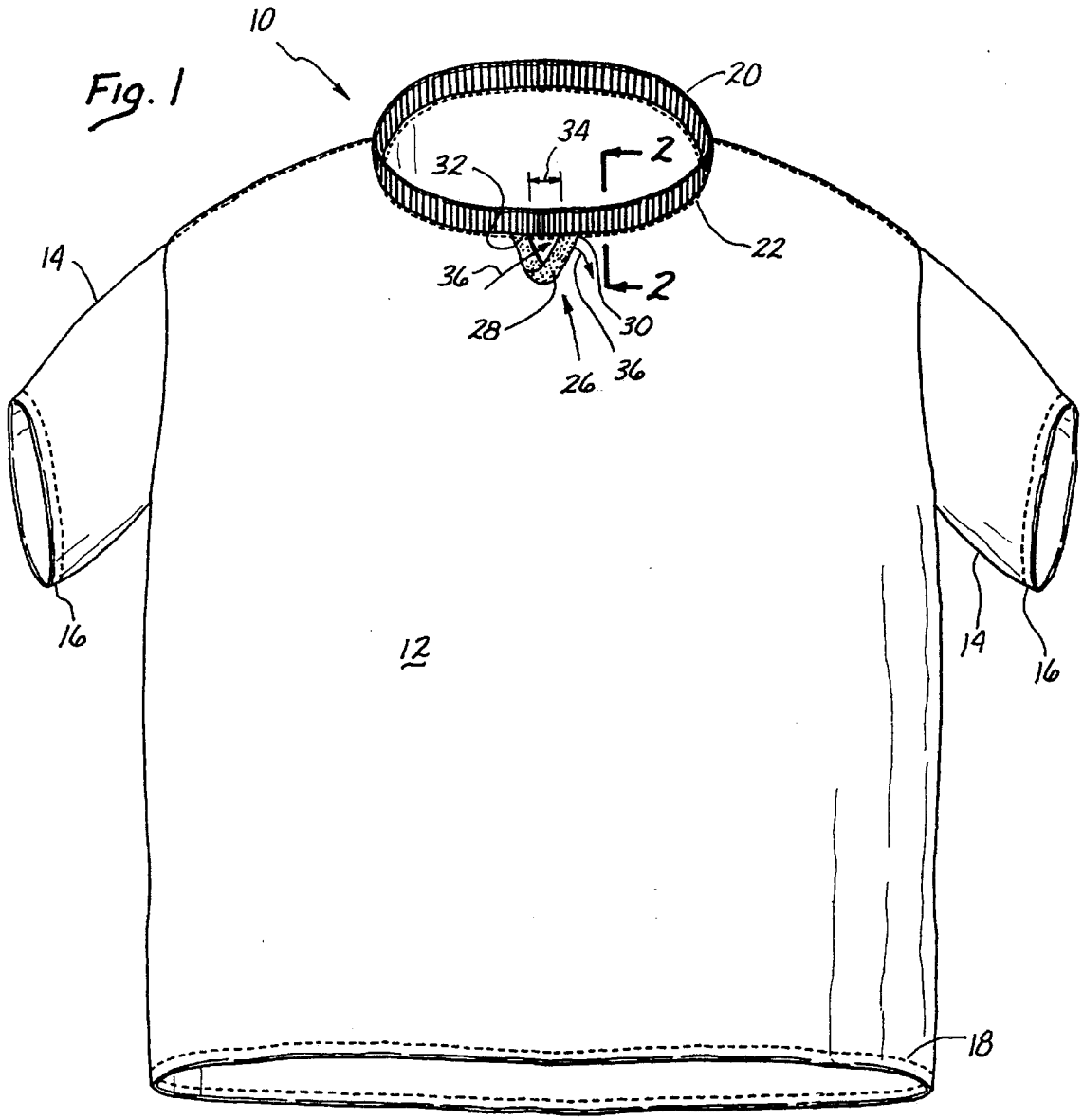
FIG. 1 is a front elevation view of a shirt garment showing the preferred embodiment of the present invention.
Figure 2:
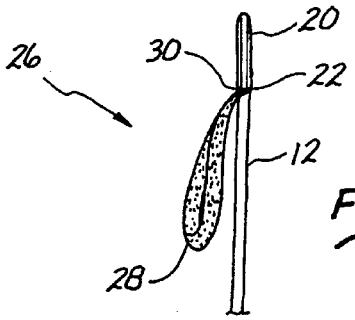
FIG. 2 is a side elevation view of a portion of the shirt of FIG. 1 taken along line 2—2, showing the preferred embodiment of the present invention.
Figure 3:
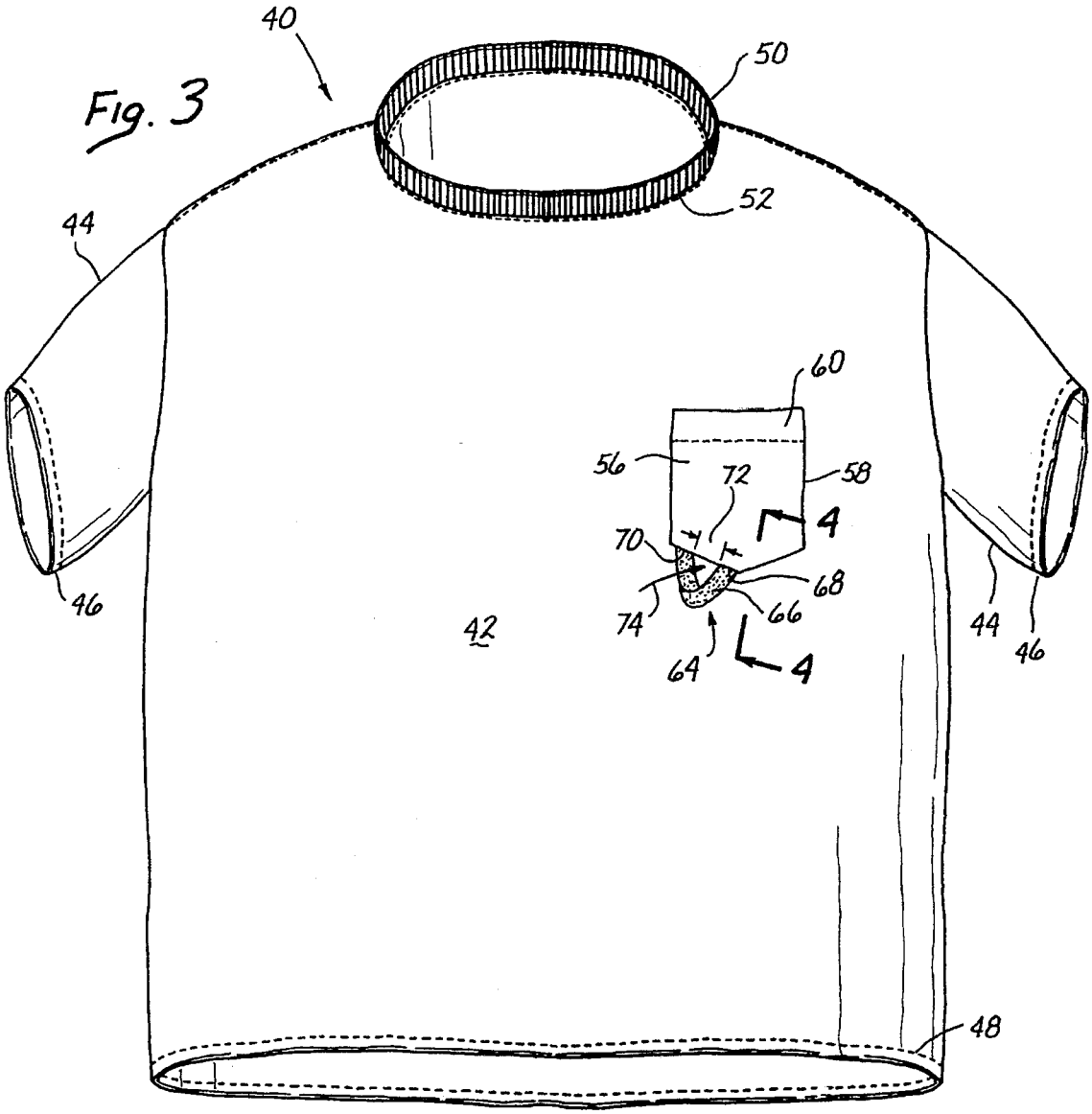
FIG. 3 is a front elevation view of a shirt garment showing an alternative embodiment of the present invention.

A shirt 10, reference being initially to FIGS. 1 and 2 of the accompanying drawings, has a front 12 and arms 14 attached to the body shown by the front 12. The arms 14 end in hems 16. The body of the shirt 10 also has a hem 18 at its lower end. The shirt 10 has a collar 20 attached to the body 12 of the shirt by a seam 22.

A loop 26 is comprised of an elongated strip 28 of material, which may be a textile and may be of the same substance as that of which the shirt 10 is made. The elongated strip 28 may be of a different material, and may be selected for its durability, such as a plastic or composite material. In any event, the material with which the elongated strip 28 is comprised will be sufficient to give some substantialness to the loop 26, such that the loop 26 will present at least a slight opening in the natural state. The elongated strip 28 has two opposing ends 30, 32, each of which is attached to the collar 20 at the seam 22. The ends 30, 32 are attached along the seam 22 at different points spaced a predetermined distance 34 apart, so that the closed loop 26 is defined by the elongated strip 28 and the seam 22 in the space 34.

As shown, the loop 26 has each of the opposing ends 30, 32 attached to the seam 22. The end 30 may be sewn into the seam 22 in the opposite orientation as the end 32 is sewn. Alternatively, the end 30 may be sewn into the seam 22 in the same orientation as the end 32 is sewn. In either combination, the loop 26 have the lowermost apex somewhat spaced from the shirt body or front 12.

An object having an arm, such as a pair of glasses may be held by the loop of the present invention by inserting an arm of the glasses' frame through the loop 26 in the direction of the arrow 36. Because the loop 26 has an extension from the body or front 12 of the shirt 10, only one hand holding the glasses' frame need be used to insert the frame arm through the loop 26, unlike loops that are closed having their two opposing ends attached to a garment at the same point. In such a attachment, where the two opposing ends of a strip are connected at the same point in a seam, two hands are frequently required to open the loop and insert an arm of the glasses' frame.

Figure 4:
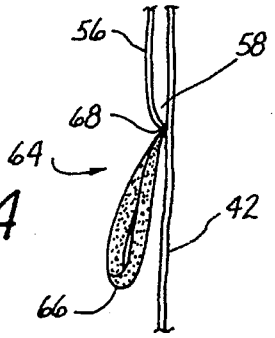
FIG. 4 is a side elevation view of a portion of the alternative embodiment of the invention taken along line 4—4 in FIG. 3; and, FIG. 5 is a side perspective view of a shirt showing another alternative embodiment of the present invention.
Figure 5:
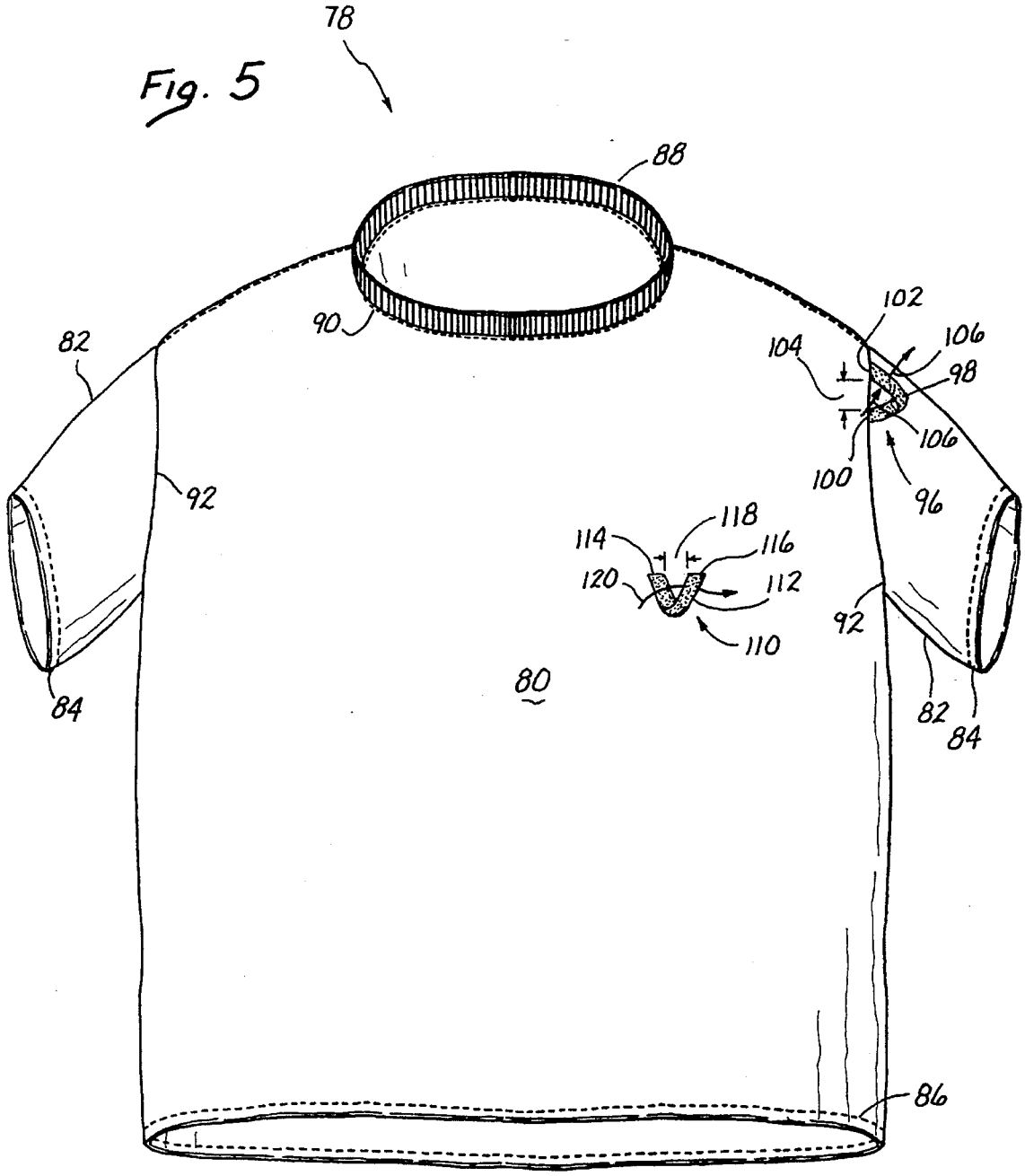

In an alternative embodiment of the present invention, as shown in FIGS. 4 and 5, a shirt 40 is shown having a body front 42. The shirt 40 has arms 44 ending in hems 46. The shirt body 42 ends in a hem 48, as well. The shirt 40 has a collar or neck band 50 attached to the shirt body 42 by seam 52. The shirt 40 of FIGS. 4 and 5, however, comprises a pocket 56 attached to the shirt body front 42 by a seam 58. The pocket 56 has a opening defined by the hem 60 of the attached pocket 56.

The seam 58 along the low attachment of the pocket 56 has depending from it a loop 64 defined by an elongated strip 66 of material and a portion of the seam 58. The elongated strip 66 has two ends 68, 70 each of which is attached at the seam 58 along the lower part of the pocket 56. The end 68 is attached to the seam 58 a predetermined, spaced distance 72 from the attachment of end 70, thus defining the loop 64 by the elongated strip 66 so attached and the seam 58 along the spaced distance 72.

As described above for the preferred embodiment of FIGS. 1 and 2 above, in the embodiment of FIGS. 4 and 5 the loop 64 has each of the opposing ends 68, 70 attached to the seam 58. The end 68 may be sewn into the seam 58 in the opposite orientation as the end 70 is sewn. Alternatively, the end 68 may be sewn into the seam 58 in the same orientation as the end 70 is sewn. In either combination, the loop 64 has the lowermost apex somewhat spaced from the shirt body or front 42.

Again, an object having an arm, such as a pair of glasses may be held by the loop of the present invention by inserting an arm of the glasses' frame through the loop 64 in the direction of the arrow 74. Because the loop 64 has an extension from the body or front 42 of the shirt 40, only one hand holding the glasses' frame need be used to insert the frame arm through the loop 26, unlike loops that are closed having their two opposing ends attached to a garment at the same point. In such a attachment, where the two opposing ends of a strip are connected at the same point in a seam, two hands are frequently required to open the loop and insert an arm of the glasses' frame.

As seen in FIG. 5, another embodiment of the present invention comprises a shirt 78 having a body front 80 and a pair of arms 82 depending from the shirt body. Each arm ends in a hem 84. The shirt body 80 also ends in a hem 86. A collar or neck band 88 is attached to the shirt 78 by a seam 90.

The arms 82 are held to the shirt body 80 by seams 92. A loop 96 is formed comprising an elongated strip 98 of material with one of the seams 92. The elongated strip 98 comprises two opposing ends 102, 104, each attached to the shirt 78 along the seam 92 holding the left hand arm 82 to the shirt 78. The end 102 is attached at the seam 92 at a point a predetermined, spaced distance 104 from the attachment of end 104, so that the loop 96 is defined by the elongated strip 98 and the portion of the seam 92 between the attachments of the ends 102, 104 along the seam 92 in the spaced distance 104.

The loop 96 has each of the opposing ends 102, 104 attached to the seam 92. Similar to the embodiments described above, the end 102 may be sewn into the seam 92 in the opposite orientation as the end 104 is sewn. Alternatively, the end 102 may be sewn into the seam 92 in the same orientation as the end 104 is sewn. In either combination, the loop 96 have the lowermost apex somewhat spaced from the shirt body or front 80.

An object having an arm, such as a pair of glasses may be held by the loop of the present invention by inserting an arm of the glasses' frame through the loop 96 in the direction of the arrow 106. Because the loop 96 has an extension from the body or front 80 of the shirt 78, only one hand holding the glasses' frame need be used to insert the frame arm through the loop 96, unlike loops that are closed having their two opposing ends attached to a garment at the same point. In such a attachment, where the two opposing ends of a strip are connected at the same point in a seam, two hands are frequently required to open the loop and insert an arm of the glasses' frame.

In yet another alternative embodiment, or cumulative or as an addition to the embodiment just described, a loop 110 may be attached to the front 80 of the shirt 78, that is, on the plain surface 80. The loop 110 comprises a strip 112 of material joined at its two ends 114 and 116 to the front 80 as predetermined distance 118 from each other to define the closed loop 110. An arm of an object, such as the arm of a pair of glasses may be inserted through the loop 110 in the direction of arrow 120 so that the pair of glasses are held to the shirt 78 even though the wearer may bend over so as to effectively turn the shirt in a generally upside down orientation.

The spaced distance 34, 72, 104, 118 between the connections of the ends 30, 32, and between the ends 68, 70, between the ends 102, 104 and between the ends 114, 116 should be determined by distance which will make the insertion of the object's arm simple and capable of being executed using only one hand, namely the hand holding the object. It has been found that the distance 34, 72, 104, 118 should be no less than the largest cross-sectional dimension of the arm of the object being inserted through the loop 26, 64, 96, 110. It may be desired to make the predetermined distance 34, 72, 104, 118 between the connections 30 and 32, 68 and 70, 102 and 104 and 114 and 116 at least one half the length of the corresponding elongated strip 28, 66, 98, so that the portion of the loop 26, 64, 96, 110 defined by the seam or the shirt itself will be a generally equal side to a generally triangularly shaped loop 26, 64, 96, 110. It is believed, however, that best results are achieved when the predetermined distance 34, 72, 104, 118 is approximately equal to or the same as the maximum height of the loop apex from the line defined by the two ends of the strip 28, 66, 98, 112 forming the loop 26, 64, 96, 110.

The foregoing description of my invention and of preferred embodiments as to products, compositions and processes is illustrative of specific embodiments only. It is to be understood, however, that additional embodiments may be perceived by those skilled in the art. For example, shirts and like body garments having differing configurations may be readily adapted to have the extended loop shown and described herein to describe additional embodiments. The embodiments described herein, together with those additional embodiments, are considered to be within the scope of the present invention, which is to be defined only by the appended claims.

I claim:

1. In a shirt for wearing having a front and a generally horizontal seam in said front attaching parts of said shirt together, closed loop means defined at least partially by said generally horizontal seam and at least partially depending from said seam, for suspending from said shirt an object having at least one appendage capable of insertion through said loop means, said loop means comprising:

(a) an elongated strip having a predetermined length and two ends attached to said seam normal to said horizontal seam, (b) a first of said ends being attached to said shirt at said seam at a first point, and a second of said ends being attached to said shirt at said seam at a second point spaced a predetermined distance which is less than said strip length along said seam from said first point, which said predetermined distance defines substantially the widest width of said loop means.

2. The shirt of claim 1 wherein at least one of said parts of the shirt comprises a collar, and wherein said first and said second points along said seam are positioned along said seam attaching said collar.

3. The shirt of claim 1 wherein at least one of said parts of the shirt comprises a pocket attached to said shirt by at a seam, and wherein said first and said second points along said seam are positioned along said seam attaching said pocket.

4. The shirt of claim 1 wherein at least one of said parts of the shirt comprises an arm, and wherein said first and said second points along said seam are positioned along said seam attaching said arm.

5. A shirt for wearing having a surface comprising loop means defined at least partially by said surface and at least partially depending from said surface, for suspending from said shirt an object having at least one appendage, said loop means comprising an elongated strip having a length with two ends, a first of said ends being attached to said surface of said shirt at a first point on a seam of said shirt, and a second of said ends being attached to said shirt at a second point spaced a predetermined distance which is generally horizontal with said first point when the shirt is worn which is less than the length of said strip along said seam from said first point.

* * * * *